US006203002B1

(12) United States Patent
Ference

(10) Patent No.: US 6,203,002 B1
(45) Date of Patent: Mar. 20, 2001

(54) APPARATUS AND METHOD FOR SORTING MAIL

(75) Inventor: Jeff Ference, Malabar, FL (US)

(73) Assignee: Profold, Inc., Sebastian, FL (US)

( * ) Notice: Subject to any disclaimer, the term of this patent is extended or adjusted under 35 U.S.C. 154(b) by 0 days.

(21) Appl. No.: 09/315,693

(22) Filed: May 20, 1999

(51) Int. Cl.[7] ..... B65H 5/00; B65H 29/38; B65H 29/70; B65H 39/10

(52) U.S. Cl. ..... 271/2; 271/299; 271/177; 271/188

(58) Field of Search ..... 271/2, 299, 188, 271/177, 178; 209/919, 900

(56) References Cited

U.S. PATENT DOCUMENTS

| | | | | |
|---|---|---|---|---|
| 3,087,724 | | 4/1963 | Snowdon et al. | 271/71 |
| 3,595,568 | * | 7/1971 | Roskam | 271/89 X |
| 3,799,539 | | 3/1974 | Del Rio | 271/188 |
| 4,019,730 | * | 4/1977 | Staudinger et al. | 271/181 |
| 4,524,965 | * | 6/1985 | Kulpa | 271/214 X |
| 4,781,371 | * | 11/1988 | Stemmle | 271/293 X |
| 4,824,091 | * | 4/1989 | Knight | 271/178 |
| 5,199,700 | | 4/1993 | Fairey et al. | 271/209 |
| 5,295,674 | * | 3/1994 | Zoltner | 271/2 |
| 5,524,876 | * | 6/1996 | Porter | 271/178 |
| 5,891,300 | | 4/1999 | Oussni, Jr. et al. | 156/541 |

FOREIGN PATENT DOCUMENTS

| | | | |
|---|---|---|---|
| 1120984 | 12/1961 | (DE) . | |
| 1253170 | 10/1967 | (DE) . | |
| 1173893 | 3/1959 | (FR) . | |
| 2 686 868 | 8/1993 | (FR) | B65H/29/70 |
| 1094308 | 12/1967 | (GB) | B65H/31/06 |

* cited by examiner

*Primary Examiner*—Christopher P. Ellis
*Assistant Examiner*—Kenneth W Bower
(74) *Attorney, Agent, or Firm*—Allen, Dyer, Doppelt, Milbrath & Gilchrist, P.A.

(57) ABSTRACT

An apparatus and method for sorting mail is disclosed. A mail bin receives individual mail pieces in vertical orientation from the discharge end of a feed belt assembly. The feed belt assembly includes at least one brush roll positioned at the discharge end of the feed belt assembly for imparting a concave profile to the mail upon discharge to aid in reducing any damage to a side edge of the individual mail piece discharged into the mail bin.

27 Claims, 2 Drawing Sheets

APPARATUS AND METHOD FOR SORTING MAIL

FIELD OF THE INVENTION

This invention relates to the field of article delivery, and more particularly, this invention relates to the field of sorting mail.

BACKGROUND OF THE INVENTION

In current post office operations, in one aspect of mail processing, mail is delivered on a flat conveyor in a horizontal configuration where a label is applied onto the mail. A bar code is then placed on the label. After label application, the mail is stored in a mail bin. The mail is conveyed horizontally on a belt conveyor and then into a horizontal-to-vertical belt assembly that turns the mail 90 degrees to orient the mail vertically. The mail then passes through a feed belt assembly that is formed from parallel feed belts, which apply pressure to the mail between the feed belts and advance the mail into the mail bin.

Usually the mail is discharged by the feed belt assembly into a rectangular configured mail bin having two parallel side walls. The mail is discharged from the feed belt assembly against one of the side walls by injecting the mail vertically and engaging the side edge against the mail bin wall. As the individual mail pieces are discharged into the mail bin, an end wall, which is biased forward, is pressed backward by the mail that is discharged from the feed belt assembly. Each mail piece initially engages with its side edge the parallel side wall of the mail bin located at the far end from the belt conveyor. With foreign mail that is often placed in thin envelopes, the side edge portion of the mail piece that first engages the side wall crumbles or folds, and causes stacking problems and inherent damage to the mail, and slowing mail processing downstream.

SUMMARY OF THE INVENTION

It is therefore an object of the present invention to provide an apparatus and method for sorting mail that allows discharge of individual mail pieces from a feed belt assembly into a mail bin without damaging the side edge of an individual mail piece.

In accordance with the present invention, the apparatus sorts mail and includes a mail bin for receiving individual mail pieces. A feed belt assembly feeds individual mail pieces in vertical orientation along a predetermined path of travel. The feed belt assembly has a mail discharge end positioned adjacent the mail bin for discharging mail pieces into the mail bin. The feed belt assembly includes at least one brush roll positioned at the discharge end of the feed belt assembly for imparting a concave profile to the mail upon discharge to aid in reducing any damage to a side edge of each individual mail piece discharged into the mail bin.

In still another aspect of the present invention, at least one brush roll includes an upper brush and lower brush for pushing over upper and lower edge portions of an individual mail piece to impart a concave orientation to the mail piece. A second brush roll can be positioned adjacent the first brush roll. The second brush roll has upper and lower brushes. A feed belt can be positioned adjacent the first and second brush rolls such that mail is passed between the two brush rolls and the feed belt.

In still another aspect of the present invention, the mail bin comprises a rectangular configured holding bin having parallel side walls. The mail is discharged against one of the side walls. A biased end wall is moveable for expanding space within the mail bin upon discharge of individual mail pieces into the mail bin. At least one brush roll includes a flat belt pulley. The feed belt assembly includes a flat drive belt that is received over the flat belt pulley for rotating the brush roll as the feed belt assembly feeds individual mail pieces along the predetermined path of travel.

In still another aspect of the present invention, the first brush roll has a top belt pulley and the second brush roll has a top belt pulley. A drive belt is received over the top belt pulleys of first and second brush rolls such that as a driving force is imparted onto the flat belt pulley on the first brush roll, a driving force is imparted onto the second brush roll via the drive belt.

The second brush roll can be mounted on a slidable bracket. The slidable bracket can be slid forward and backward to move the second brush roll and adjust clearance between the second brush roll and the feed belt for accommodating mail pieces of different width. A tension arm is mounted on the bracket and has a top pulley on which the drive belt is received.

In still another aspect of the present invention, a plurality of mail bins can be positioned adjacent to each other for receiving mail pieces. Each mail bin can be fed mail from a respective feed belt assembly.

In a method aspect of the present invention, the method comprises the steps of feeding individual mail pieces in vertical orientation along a predetermined path of travel into a mail bin. While feeding the mail, a concave profile is imparted to the individual mail pieces upon discharge into the mail bin to aid in reducing any damage to a side edge of each individual mail piece. In still another aspect of the present invention, the method comprises the step of feeding the mail by driving a plurality of closely positioned drive belts for advancing individual mail pieces. In still another method aspect of the present invention, a concave profile is imparted by the step of pushing over upper and lower edge portions of individual mail pieces with at least one brush roller having upper and lower brushes that engage the upper and lower edge portions. The first brush roll can be driven with a flat belt pulley and a second brush roll can be driven from the first brush roll. One of the brush rollers can be mounted on a tension arm.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
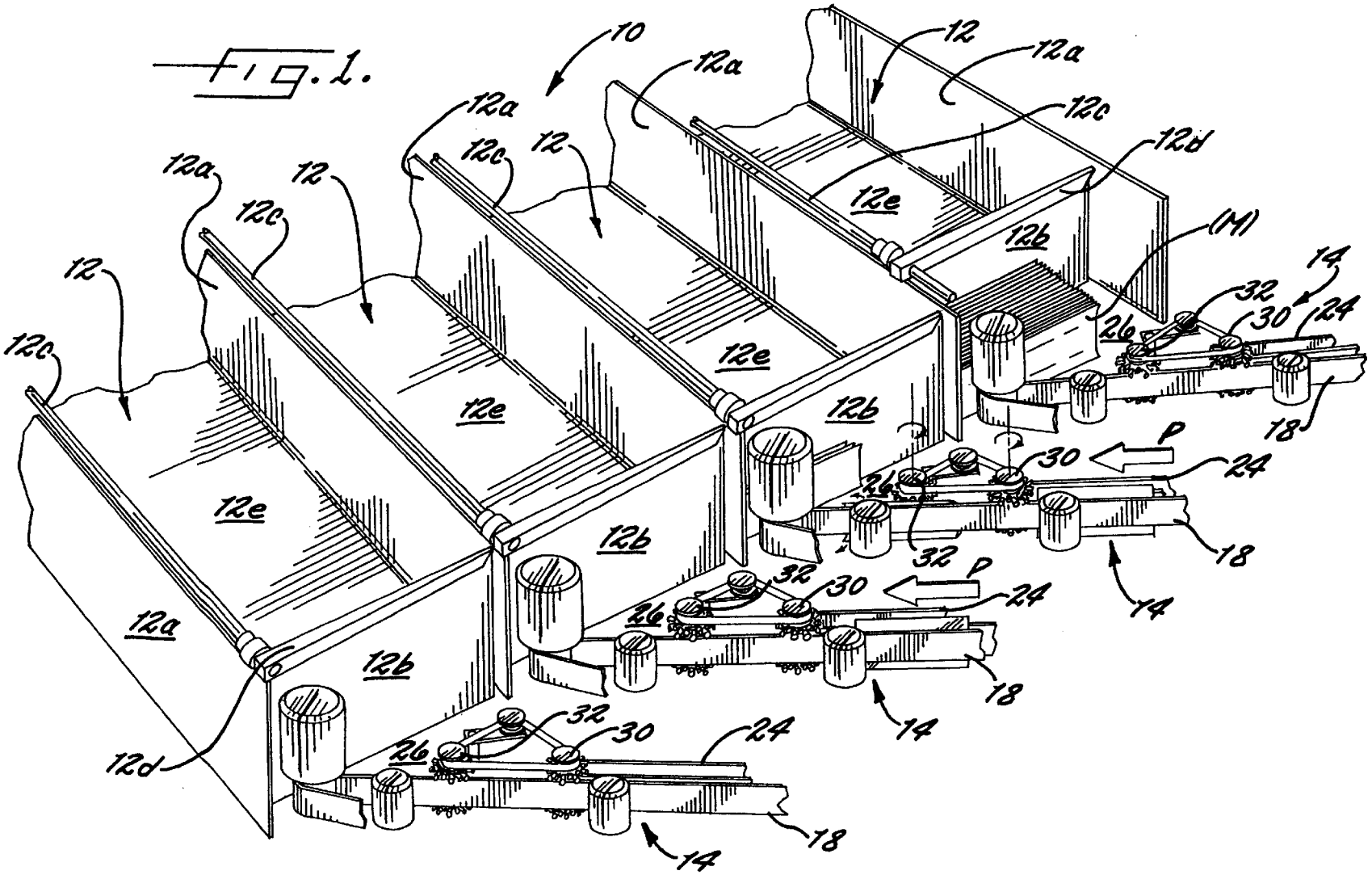
FIG. 1 is a perspective view of a plurality of mail bins that receive mail from a plurality of feed belt assemblies in accordance with the present invention.

Referring now to FIG. 1, there is illustrated the apparatus 10 of the present invention that sorts mail by feeding individual mail pieces (M) in vertical orientation along a predetermined path of travel (P) into a respective mail bin 12. The mail can include mixed mail pieces (M) that have different sizes, including different lengths and widths of the mail and different thicknesses.

As evident, the apparatus discloses four mail bins 12 that receive mail from four respective feed belt assemblies 14. Although four mail bins 12 and four feed belt assemblies 14 are illustrated, naturally, the apparatus can include one, two or any number of different mail bins having respective feed belt assemblies as necessary for the processing of mail. Each mail bin 12 includes two parallel side walls 12*a* and a biased end wall 12*b,* forming a rectangular configuration. The end wall 12*b* is slidable on a support rod 12*c* via a support flange 12*d* that extends across the top portion of the end wall 12*b*. A bottom surface 12*e* holds the mail. Sheet steel, plastic or other materials known to those skilled in the art can be used to construct the mail bin 12.

The mail (M) is fed by the feed belt assembly 14 in a vertical orientation, and not horizontal, as illustrated. However, the mail often is processed in areas upstream in a horizontal orientation. For example, labels often are placed on the mail pieces in a label application station 15 (FIG. 2) before sorting into the mail bins 12. The mail then is fed to a horizontal-to-vertical belt assembly 16 that turns the mail 90 degrees into a vertical orientation, as is well known to those skilled in the art. The mail enters the feed belt assembly 14 having at least one large longitudinally extending feed belt 18 that is driven by a drive roller 20 connected to a drive motor 21 at the belt end 18*a* defined by the endless loop. The belt 18 engages stationary tension rolls 22 that maintain pressure on the feed belt 18. The feed belt 18 is a flat belt. Positioned adjacent the feed belt is another flat drive belt 24. The mail is passed between the endless loop feed belt 18 and the endless loop flat drive belt 24.

Figures 2, 3, 4:
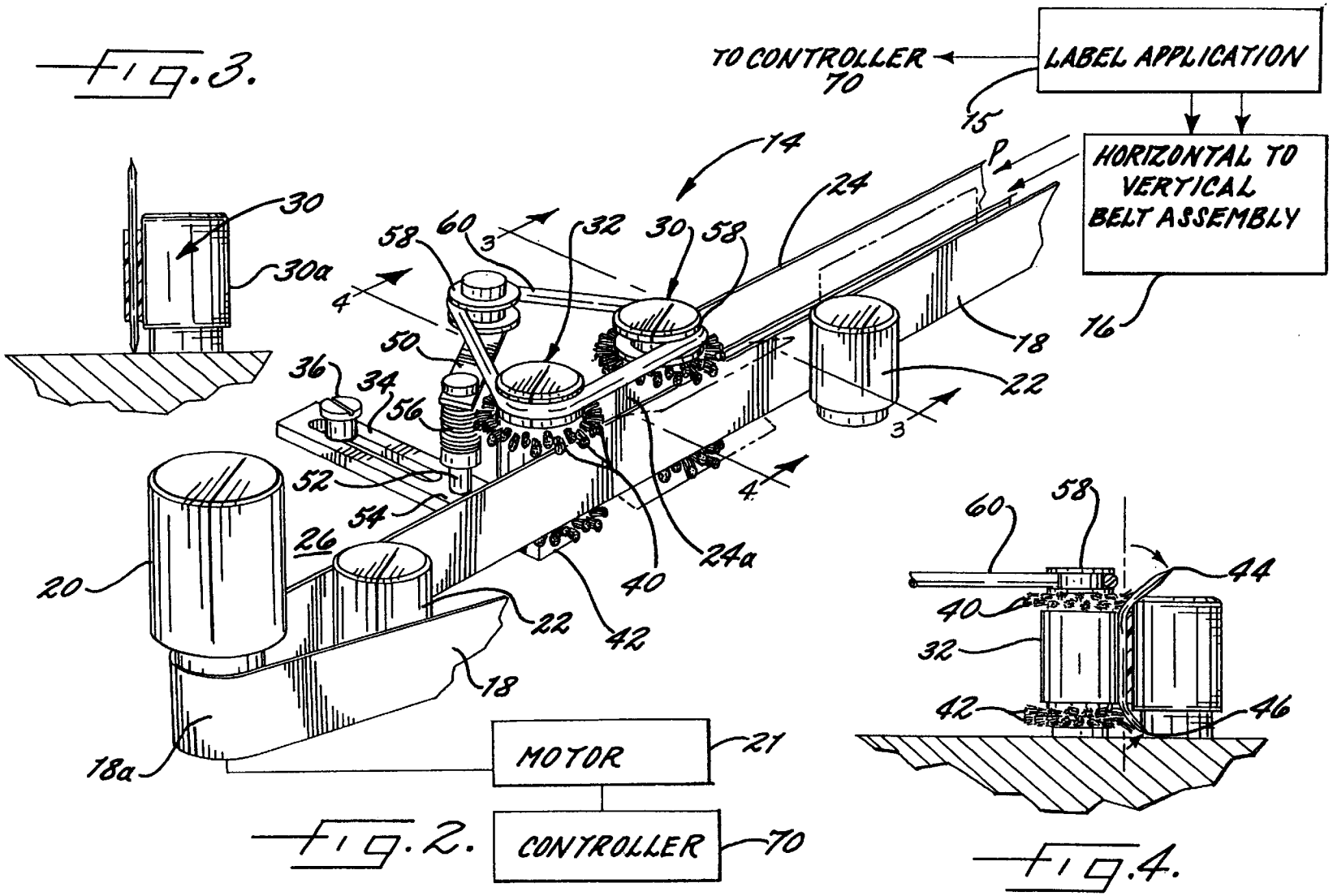
FIG. 2 is an enlarged perspective view of the discharge end of one feed belt assembly showing first and second brush rollers, the slidable bracket and tension arm.
FIG. 3 is a sectional view taken along line 3—3 of FIG. 2.
FIG. 4 is a side sectional view taken along line 4—4 of FIG. 2.

As illustrated, in accordance with the present invention, the feed belt assembly 14 includes a discharge end positioned adjacent the mail bin 12 for discharging mail pieces into the mail bin 12. The feed belt assembly 14 at its discharge end 26 includes first and second brush rolls 30,32 positioned at the discharge end of the feed belt assembly for imparting a concave profile to the mail to aid in reducing any damage to a side edge of each individual mail piece (FIG. 4). The first brush roller 30 includes a medial portion formed as a flat belt pulley 30*a* that receives the end loop 24*a* of the flat drive belt 24. Individual mail pieces are positioned between the feed belt 18 and the flat drive belt 24. As the belts 18,24 are driven, they rotate in their continuous endless loop and the mail pieces (M) are advanced forward through the feed belt assembly to the discharge end.

As illustrated, the second brush roll 32 is positioned downstream and adjacent the first brush roll 30 and mounted on a bracket 34 that is slidable back and forth against the feed belt 18. The bracket 34 can be tightened into a desired position by a screw 36, which could be a thumb screw or a screw that receives the slotted edge of the screwdriver, as illustrated. First and second brush rolls 30,32 each include upper and lower brushes 40,42 that engage the mail pieces as shown in FIGS. 2 and 4 and press against upper and lower edge portions 44,46 of an individual mail piece to impart a concave configuration to the mail piece. Thus, as mail is discharged through the discharge end 26 of the feed belt assembly 14, the mail piece's imparted concave configuration allows the individual mail piece to hit the side wall 12*a* of the rectangular configured mail bin 12 with added strength. The concave configuration of the mail upon discharge imparts greater strength against folding and crumbling to the individual mail piece (M) such that it will reduce any chance that the side edge of an individual mail piece will be damaged as the side edge strikes the side wall 12*b* of the mail bin upon discharge.

A tension arm 50 is mounted on the bracket 34. The tension arm 50 can be mounted by a shaft 52 and ball mount 54 to allow rotative movement of the tension arm about a pivot axis defined by the support shaft. A spring 56 biases the tension arm 50 away from the two brush rollers 30,32. The tension arm 50 includes a round belt pulley 58 on its top. First and second brush rollers each include on their top a round belt pulley 58. A round drive belt 60 engages the round belt pulleys 58. As the flat drive belt 24 rotates the first brush roll 30, the round drive belt 60 rotates the second brush roll 32, while the tension arm 50 imparts a biasing force against the round belt pulley 58. The tension arm 50 acts as a safety feature. If a machine operator were to place their hand within the feed belts 18,24, the force of the hand against the different feed belts would cause the tension arm to move, and thus, cause the second brush roller 32 to stop rotating. The spring is biased to allow sufficient force for operation, but not great enough biasing to prevent its operation as a safety feature.

In operation, the individual mail pieces (M) are fed through the feed belt assembly 14 where the mail pieces engage first and second brush rollers 30,32. The second brush roller will have been adjusted a set distance from the feed belt 18 to accommodate a desired thickness of individual mail piece as shown in FIG. 3. The entire operation can be controlled via a controller 20 that includes a central processing unit and microprocessor to control operation of the overall machine, which could include labeling sections and other areas not shown. The two brush rollers impart a concave configuration to each mail piece. As mail is discharged in its concave configuration, the mail hits the side wall 12*a* and accumulates, pushing back the biased end wall 12*b,* which is spring loaded to exert a forward biasing pressure against the individual mail pieces. Thus, in accordance with the present invention, individual mail pieces are less prone to side edge damage as they are fed into the mail bin.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An apparatus for sorting mail comprising:

a mail bin for receiving individual mail pieces; and a feed belt assembly for feeding individual mail pieces in vertical orientation along a predetermined path of travel, said feed belt assembly having a mail discharge end positioned adjacent the mail bin for discharging mail pieces into the mail bin, said feed belt assembly further comprising a brush roll positioned at the discharge end of the feed belt assembly for pushing over upper and lower edge portions of an individual mail piece and imparting a concave profile to each individual mail piece upon discharge to aid in reducing any damage to a side edge of each individual mail piece discharged into the mail bin.

2. An apparatus according to claim 1, wherein said mail bin comprises a rectangular configured holding bin having parallel side walls, wherein said mail is discharged against one of said sidewalls, and a biased end wall that is movable for expanding space within the mail bin upon discharge of individual mail pieces into the mail bin.

3. An apparatus according to claim 1, wherein said brush roll includes a flat belt pulley and said feed belt assembly further comprises a flat drive belt that is received over said flat belt pulley for rotating said brush roll as said feed belt assembly feeds individual mail pieces along said predetermined path of travel.

4. An apparatus according to claim 1, wherein said brush roll includes an upper brush and a lower brush for pushing over upper and lower edge portions of an individual mail piece to impart a concave orientation to an individual mail piece.

5. An apparatus according to claim 4, and further comprising a second brush roll positioned adjacent said first brush roll, said second brush roll including an upper brush and a lower brush.

6. An apparatus according to claim 5, wherein said feed belt assembly is positioned adjacent the first and second brush rolls such that mail is passed between the two brush rolls and the feed belt.

7. An apparatus for sorting mail comprising:

a mail bin for receiving mail pieces; and a feed belt assembly for feeding individual mail pieces in vertical orientation along a predetermined path of travel, said feed belt assembly having a mail discharge end positioned adjacent the mail bin for discharging mail pieces into the mail bin, said feed belt assembly further comprising first and second brush rolls positioned at the discharge end of the feed belt assembly for imparting a concave profile to the mail to aid in reducing any damage to a side edge of each individual mail piece, wherein said first brush roll has a top belt pulley and a flat pulley in a medial portion of the brush roll, a flat drive belt received over the flat pulley;

said second brush roll having a top belt pulley; and said drive belt received over said top belt pulleys of said first and second brush rolls such that as a driving force is imparted onto the flat belt pulley on the first brush roll, and said driving force is imparted onto the second brush roll via the drive belt.

8. An apparatus according to claim 7, wherein said first and second brush rolls each comprise a roll having an upper brush and a lower brush for pushing over upper and lower edge portions of an individual mail piece to impart a concave orientation to the individual mail piece.

9. An apparatus according to claim 7, wherein said mail bin comprises a rectangular configured holding bin having parallel side walls, wherein said mail is discharged against one of said sidewalls, and a biased end wall that is movable for expanding space within the mail bin upon discharge of individual mail pieces into the mail bin.

10. An apparatus according to claim 7, wherein said feed belt assembly is positioned adjacent the first and second brush rolls such that mail is passed between the two brush rolls and the feed belt.

11. An apparatus according to claim 10, and further comprising a slidable bracket on which said second brush roll is mounted, wherein said slidable bracket can be slid forward and backward to move said second brush roll and adjust clearance between said second brush roll and said feed belt for accommodating mail pieces of different width.

12. An apparatus according to claim 11, and further comprising a tension arm mounted on said bracket, said tension arm having a top belt pulley on which said drive belt is received.

13. An apparatus for sorting mail comprising:

a plurality of mail bins for receiving mail pieces; and a plurality of feed belt assemblies for feeding individual mail pieces in vertical orientation along predetermined paths of travel to the mail bins, said feed belt assemblies each comprising a mail discharge end positioned adjacent a respective mail bin for discharging mail pieces into a respective mail bin, wherein each of the plurality of feed belt assemblies further comprises a brush roll positioned at the discharge end of each of the plurality of feed belt assemblies for pushing over upper and lower edge portions of an individual mail piece for imparting a concave profile to the mail pieces upon discharge to aid in reducing any damage to a side edge of each individual mail piece discharged into a respective mail bin.

14. An apparatus according to claim 13, wherein each brush roll of the plurality of feed belt assemblies includes an upper brush and a lower brush for pushing over upper and lower edge portions of an individual mail piece to impart a concave orientation to the individual mail piece.

15. An apparatus according to claim 13, wherein said mail bin comprises a rectangular configured holding bin having parallel side walls, wherein said individual mail pieces are discharged against one of said sidewalls, and a biased end wall that is movable for expanding space within the mail bin upon discharge of individual mail pieces into the mail bin.

16. An apparatus according to claim 13, wherein said brush rolls include a flat belt pulley and said feed belt assembly further comprises a flat drive belt that is received over said flat belt pulley for rotating each brush roll as said feed belt assembly feeds individual mail pieces along said predetermined path of travel.

17. An apparatus according to claim 13, and further comprising a second brush roll positioned adjacent the first brush roll, said second brush roll having upper and lower brushes.

18. An apparatus according to claim 17, and further comprising a feed belt that is positioned adjacent the first and second brush rolls such that mail is passed between first and second brush rolls and the feed belt.

19. A method for sorting mail comprising the steps of:

feeding individual mail pieces in vertical orientation along a predetermined path of travel into a mail bin; and while feeding the mail, imparting a concave profile to the individual mail pieces upon discharge into the mail bin by pushing over upper and lower edge portions of individual mail pieces to aid in reducing any damage of a side edge of each individual mail piece.

20. A method according to claim 19, and further comprising the step of feeding the mail by driving a plurality of closely positioned drive belts for advancing individual mail pieces.

21. A method according to claim 19, and wherein said step of imparting a concave profile comprises the step of pushing over upper and lower edge portions of individual mail pieces with at least one brush roller having upper and lower brushes.

22. A method for sorting mail comprising the steps of:

feeding individual mail pieces in vertical orientation along a predetermined path of travel into a mail bin; and while feeding the individual mail pieces, imparting a concave profile to each individual mail piece upon discharge of the individual mail piece into a mail bin to aid in reducing any folding of a side edge of each individual mail piece by pushing over upper and lower edge portions of each individual mail piece by engaging upper and lower brushes positioned on each of respective first and second brush rolls with the respective upper and lower edge portions of an individual mail piece.

23. A method according to claim 22, and further comprising the step of feeding the mail by driving a plurality of closely positioned drive belts for advancing individual mail pieces.

24. A method according to claim 22, and further comprising the step of mounting one of the first or second brush rollers on a tension arm.

25. A method according to claim 22, and further comprising the step of driving the first brush roll with a flat belt pulley.

26. A method according to claim 25, and further comprising the step of driving the second brush roll with a drive belt that is driven from the first brush roll.

27. A method according to claim 25, and further comprising the step of biasing the second brush roll with a tension arm that engages the drive belt driven from the first brush roll.

* * * * *